United States Patent [19]

Daswick

[11] 4,154,860

[45] May 15, 1979

[54] DUAL WRAPPER METHOD OF COOKING A PREPARED MEAT PRODUCT

[76] Inventor: Alexander C. Daswick, 647 Orange Grove, South Pasadena, Calif. 91030

[21] Appl. No.: 870,297

[22] Filed: Jan. 18, 1978

Related U.S. Application Data

[60] Division of Ser. No. 654,712, Feb. 3, 1976, which is a continuation-in-part of Ser. No. 209,738, Dec. 20, 1971, abandoned.

[51] Int. Cl.[2] ..... B65B 25/22

[52] U.S. Cl. ..... 426/412; 426/113; 426/523

[58] Field of Search ..... 426/113, 114, 234, 243, 426/244, 246, 523, 120, 124, 107, 129; 229/3.5 MF, DIG. 14; 99/372-381, 384, 357, 358; 221/150 HC, 150 A

[56] References Cited

U.S. PATENT DOCUMENTS

| | | | |
|---|---|---|---|
| 2,582,692 | 1/1952 | Funke | 99/372 |
| 2,686,129 | 8/1954 | Seiferth | 426/113 X |
| 2,915,397 | 12/1959 | Talkos | 426/523 |
| 2,939,793 | 6/1960 | Richman | 99/358 |
| 3,108,531 | 10/1963 | Jepson et al. | 99/381 |
| 3,210,199 | 10/1965 | Schlaf | 426/234 X |
| 3,548,738 | 12/1970 | McDevitt | 99/357 |
| 3,751,629 | 8/1973 | Esler | 426/113 X |
| 3,830,944 | 8/1974 | Dimitriadis et al. | 426/113 |
| 3,966,972 | 6/1976 | Theimer | 426/92 |
| 4,051,266 | 9/1977 | Goltsos | 426/120 |

*Primary Examiner*—Steven L. Weinstein
*Attorney, Agent, or Firm*—Gene W. Arant

[57] ABSTRACT

Inner and outer metallic wrappers are applied to the meat patty and the bun halves, respectively, of a meat sandwich before it is cooked, and the wrappers aid in the flow of heat energy as well as restricting the flow of juices during cooking.

1 Claim, 11 Drawing Figures

FIG. 8
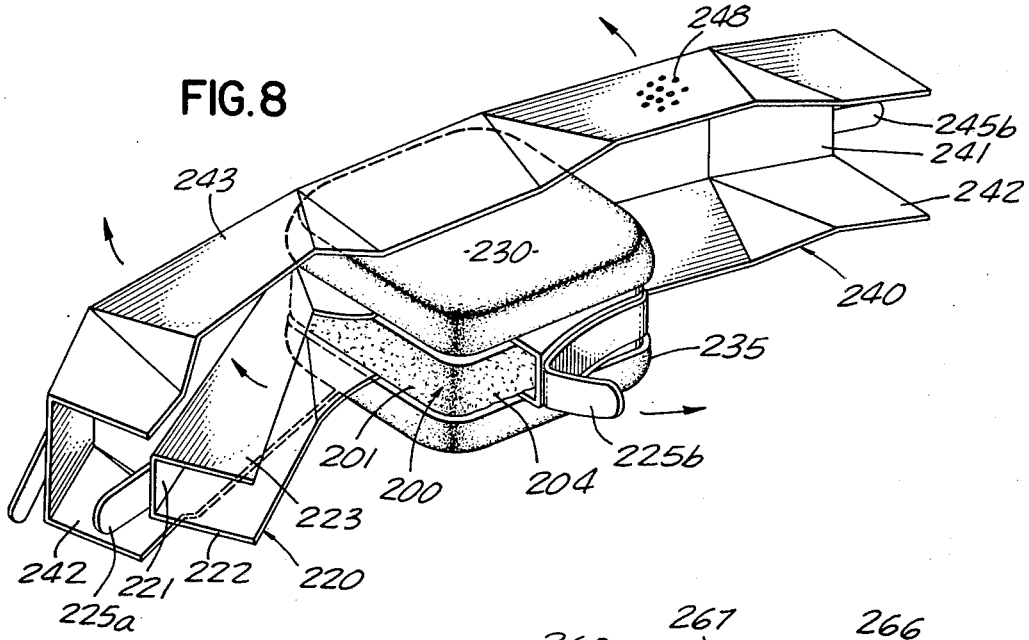
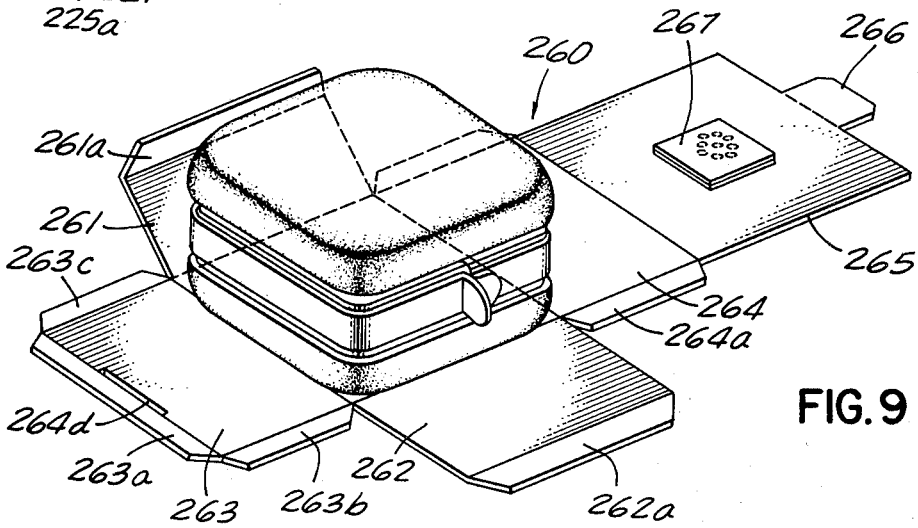
FIG. 9
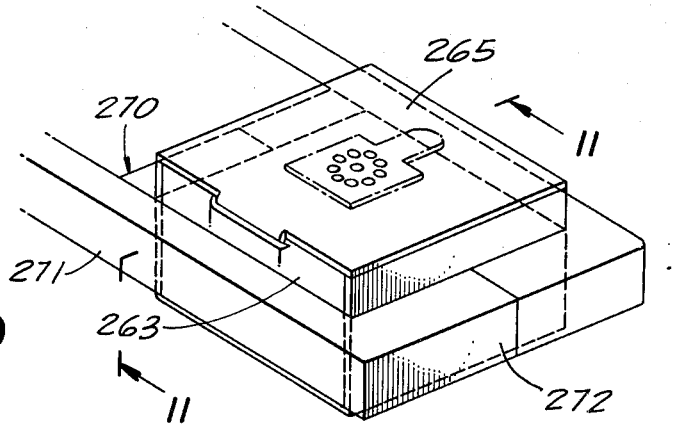
FIG. 10

DUAL WRAPPER METHOD OF COOKING A PREPARED MEAT PRODUCT

IDENTIFICATION OF REFERENCED PATENT

The present application is a division of my copending prior application Ser. No. 654,712 filed Feb. 3, 1976 which is a continuation-in-part of Ser. No. 209,738, filed Dec. 20, 1971, now abandoned. The entire drawings and specification of the patent are incorporated herein by reference in order to provide a full and complete disclosure of the present invention.

SUMMARY OF THE INVENTION

The present invention provides a method of cooking a hamburger. More particularly the invention pertains to a method which includes wrapping a hamburger patty in metallic foil, positioning the wrapped patty between two half hamburger buns in sandwich fashion, wrapping the hamburger sandwich in metallic foil, subjecting the wrapped sandwich to heat energy until the hamburger is cooked, and thereafter removing the metallic foil from the sandwich to allow for the consumption thereof.

An object and purpose of the present invention is to provide a method to cook and serve a food product much nearer to the point of consumption, specifically, to provide a method to legally cook a hamburger sandwich at a highly portable facility, such as a catering truck, and then immediately serve it to the customer for purpose of eating.

A further object of the present invention is to provide for the shielding of the hamburger, while being cooked, from the bun halves, whereby the inner wrapper is effective to restrict the outward flow of heat energy and moisture from the hamburger into the bun halves, thereby causing the meat patty to cook more rapidly.

A still further object of the present invention is to provide for the transmittal of additional meat flavoring into the hamburger bun through the exchange of the accumulated cooking juices flowing from the meat patty into the surfaces of the bun halves once the wrapper has been withdrawn from about the meat patty.

DRAWING SUMMARY

FIGS. 1 through 8, inclusive, herein corresponding to FIGS. 86 through 93, inclusive, of my referenced patent illustrate an embodiment of the invention in which a wrapped meat patty is placed between a pair of bun halves which are then covered with an outer wrapper, and energy for cooking the meat patty is then transmitted through both the outer and inner wrappers;

FIGS. 9 through 11, inclusive, corresponding to FIGS. 94 through 96, inclusive, of my referenced patent show a modified form of the foregoing embodiment.

DETAILED DESCRIPTION

Figure 1:
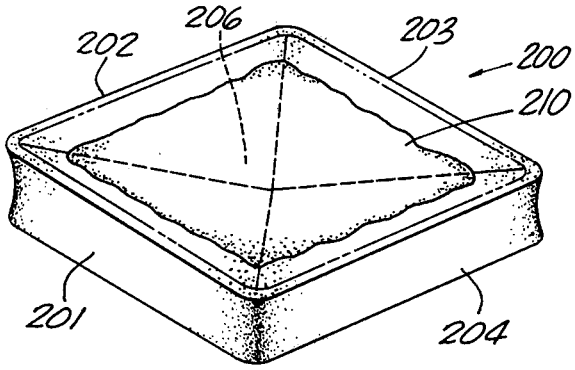
Figure 2:
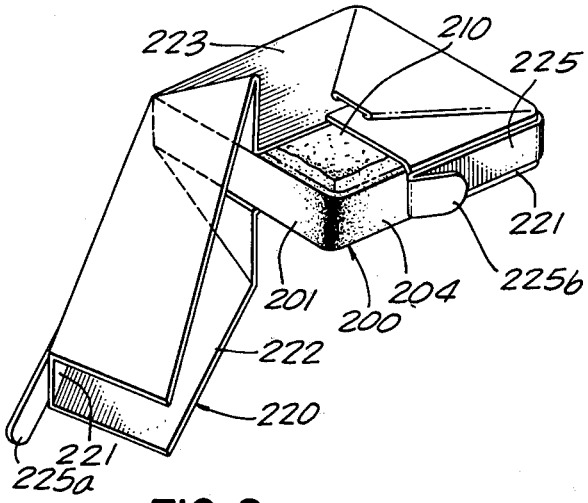
Figure 3:
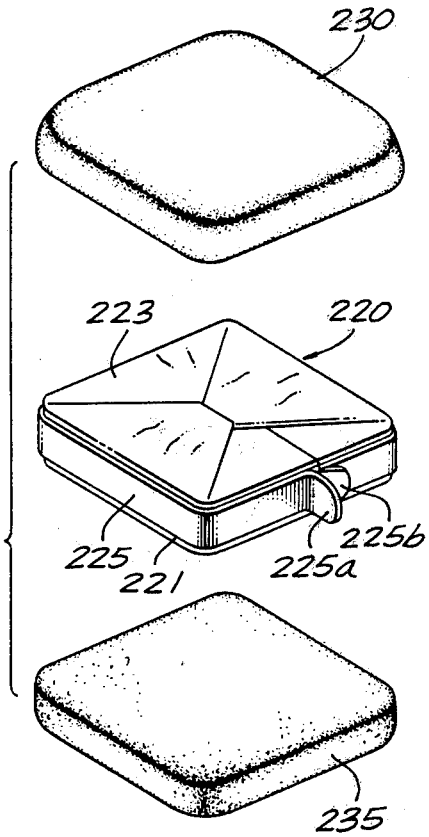
Figure 4:
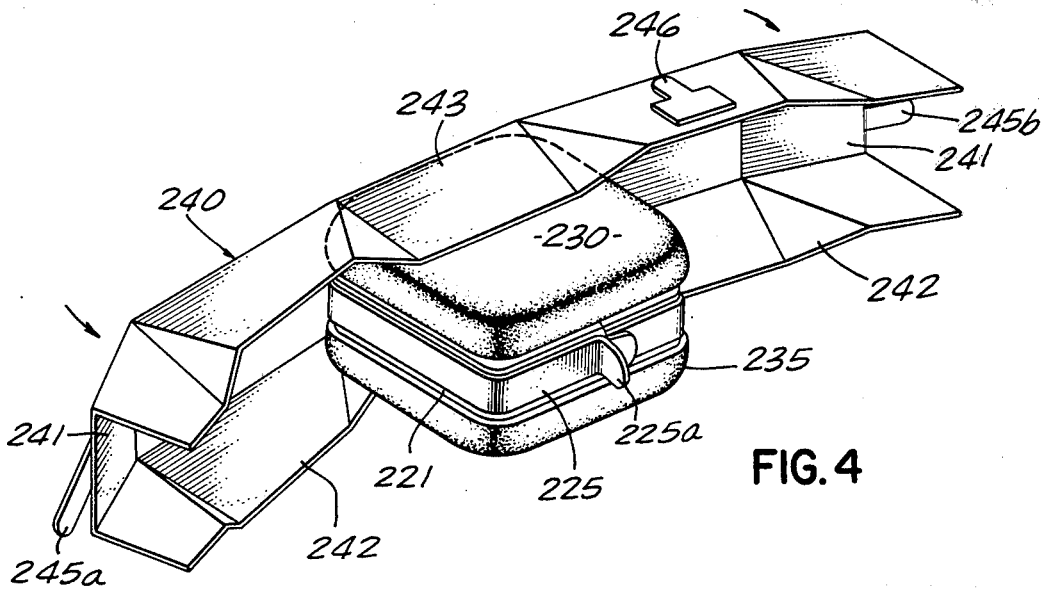
Figure 5:
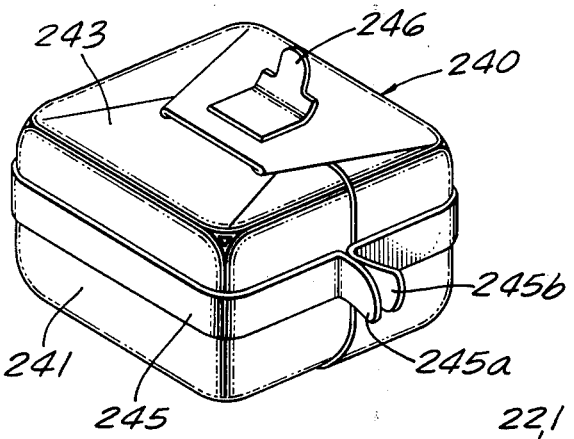
Figure 6:
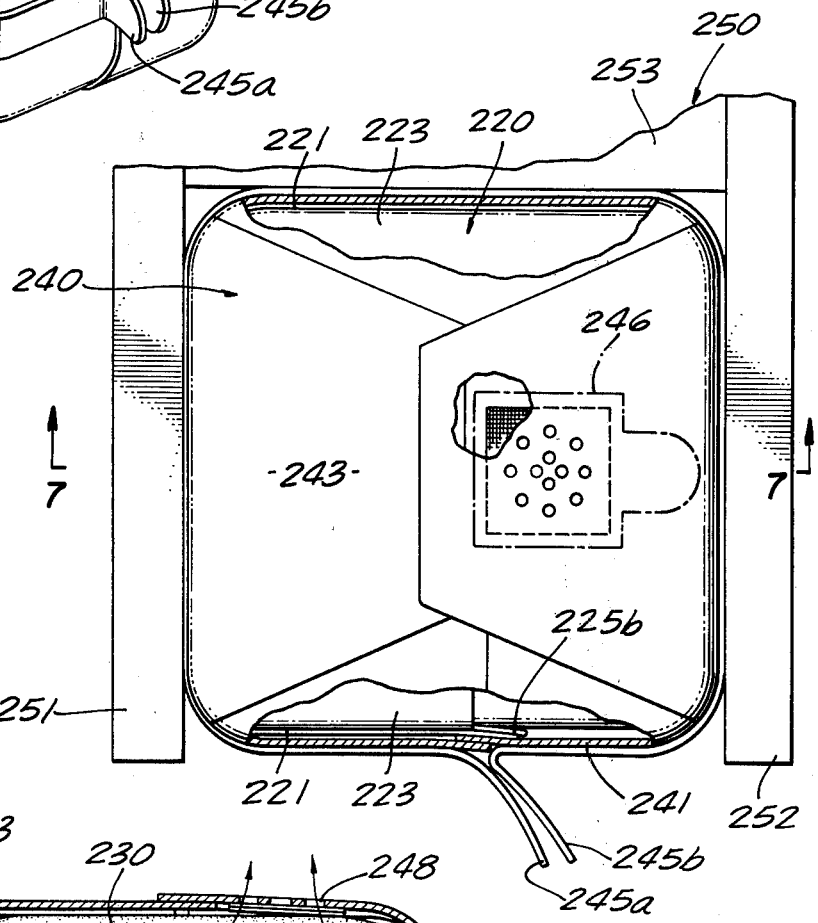
Figure 7:
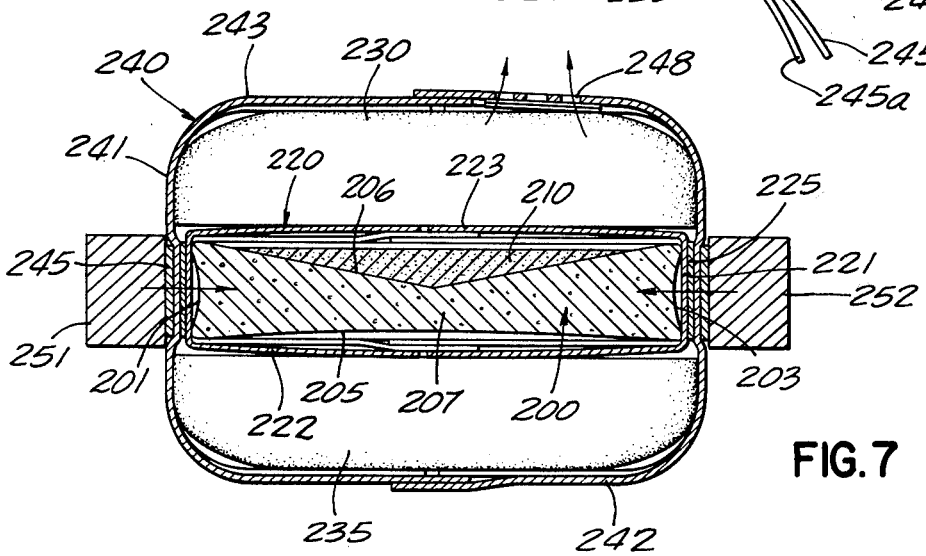

As shown in FIGS. 1–7 of the drawings, a meat patty 200 is of generally square or rectangular configuration and has a depression in its upper surface that is filled with a sauce material 210. The meat patty is wrapped in an inner metal foil wrapper 220.

Bun halves 230, 235 are placed respectively above and below the wrapped meat patty. Then an outer metal foil wrapper 240 is wrapped about the bun halves as well as the inner wrapper 220.

For cooking a hamburger, a pair of hot metal jaws 251, 252 are placed in direct engagement with the exterior surface of the outer metal foil wrapper 240, but only in locations where the outer wrapper overlies the inner wrapper. See FIGS. 6 and 7. Heat energy is therefore transmitted through both of the wrappers into the meat patty. The heated jaws are held about the sandwich until the meat patty is cooked.

After cooking, both inner and outer wrappers are removed. This phase of the operation is illustrated in FIG. 8.

Figure 11:
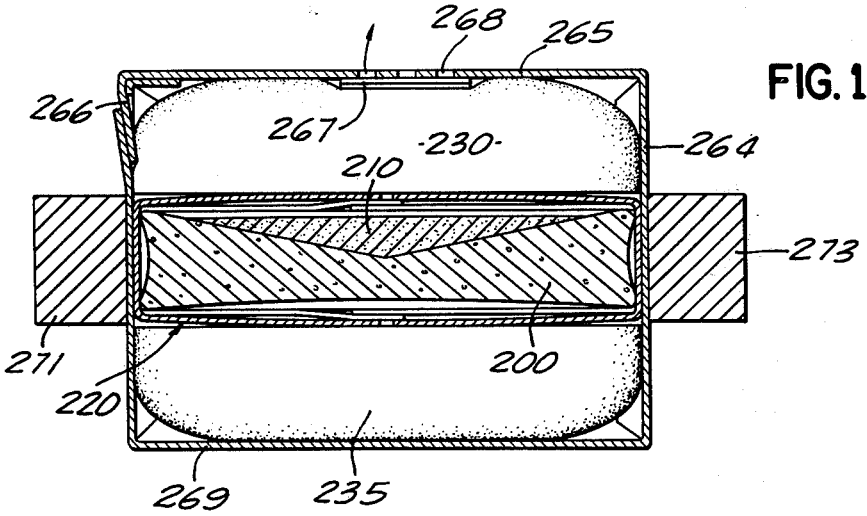

FIGS. 9–11 illustrate a modified form of the outer metal foil wrapper. Where the outer wrapper 240 was so constructed as to wrap about the hamburger sandwich in the plane of the meat patty, outer metal foil wrapper 260 functions much differently. It is placed underneath the assembled sandwich, and various panel portions are folded upwardly adjacent the corresponding sides of the sandwich so as to fully enclose the circumference of both the buns and the inner wrapper. A panel 265 also wraps over the top of the sandwich so that the entire sandwich is fully enclosed by the outer wrapper 260. The method of cooking is the same as previously described.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What I claim is:

1. The method of cooking a hamburger, comprising the steps of:

placing an inner metal foil wrapper about a meat patty to encompass the meat patty on all sides;

positioning the wrapped meat patty between a pair of bun halves;

placing an outer metal foil wrapper about the bun halves and wrapped meat patty;

placing heated metal jaws in removable engagement with the outer wrapper but only in locations where it directly overlies the inner wrapper containing said meat patty, so as to transmit heat energy through both of the wrappers and into the meat patty, until the meat patty is cooked; and then removing both wrappers;

whereby the meat patty, while it is being cooked, is shielded from intimate contact with the bun halves, and the inner wrapper is effective to restrict the outward flow of heat energy and moisture from the meat patty into the bun halves thereby causing said patty to cook more rapidly.

* * * * *